US005513773A

United States Patent [19]

Cargill

[11] Patent Number: 5,513,773

[45] Date of Patent: May 7, 1996

[54] SINGLE DENOMINATION BILL DISPENSING APPARATUS

[75] Inventor: N. Allen Cargill, Warminster, Pa.

[73] Assignee: Technitrol, Inc., Feasterville, Pa.

[21] Appl. No.: 394,704

[22] Filed: Feb. 27, 1995

[51] Int. Cl.[6] ..... B65H 1/08

[52] U.S. Cl. ..... 221/231; 321/9

[58] Field of Search ..... 221/231, 277, 221/9, 13

[56] References Cited

U.S. PATENT DOCUMENTS

| | | | |
|---|---|---|---|
| 4,821,916 | 4/1989 | Dewaele | 221/231 |
| 4,884,671 | 12/1989 | Gardellini | 194/207 |
| 5,259,490 | 11/1993 | Gardellini | 194/203 |

FOREIGN PATENT DOCUMENTS

| | | | |
|---|---|---|---|
| 75093 | 3/1990 | Japan | 221/231 |

*Primary Examiner*—Kenneth Noland

*Attorney, Agent, or Firm*—Dann, Dorfman, Herrell and Skillman

[57] ABSTRACT

An apparatus for dispensing a specified quantity of bills of a single denomination has a feed mechanism for feeding bills into a first guide path, and a transport mechanism for receiving bills within a second guide path. The first and second guide paths are arranged so that reversal of the transport mechanism causes a single bill to be dispensed from the apparatus via a gap between the two guide paths. If a misfeed is detected, the transport mechanism is maintained in forward operation to collect misfed bills within an internal rejected bill receptacle.

15 Claims, 5 Drawing Sheets

SINGLE DENOMINATION BILL DISPENSING APPARATUS

FIELD OF THE INVENTION

The present invention relates to document dispensing devices. More particularly, this invention relates to an apparatus for accurately dispensing a selected number of documents, such as currency.

BACKGROUND

Devices for dispensing paper currency are known. For example, automatic teller machines (ATM's) are widely used for automated bank transactions. In order to provide for withdrawal of funds, automatic teller machines employ paper currency dispensers. Since an ATM customer may desire to withdraw an amount ranging from as little as 5 dollars to as much as 500 dollars, the currency dispenser must be provided with supplies of several currency denominations. Such a dispenser requires a high degree of complexity and security in order to ensure that the supply is secure and that the currency is accurately dispensed. The currency dispensers in ATM's are known to cost as much as $10,000 to produce, but that cost is not an overwhelming factor in ATM applications, since an entire ATM may cost several tens of thousands of dollars.

Many vending machines must now accept one dollar bills because of the higher prices of rended products and the public's resistance to higher denomination coins. A vending machine does not ordinarily accept larger denominations of currency, since the machine would then be required to return a relatively large amount of change in coin. Hence, a customer with a higher-denomination bill must first obtain one dollar bills in order to use such a machine. The inability of most vending machines to make change in paper currency deters the use of such machines and results in substantial lost sales.

The process of providing one dollar bills to customers who use higher denominations can be automated, but providing automated paper currency changing machines has heretofore been hampered by the high cost of accurate and secure bill dispensing machines. In contrast to conventional ATM's, the cost of a paper currency changing machine must be kept as low as possible since such a machine does not itself generate revenue. Hence, it would be desirable to provide a simple low-cost apparatus for dispensing a single denomination of paper currency.

In addition to changing currency, a low-cost apparatus for dispensing a single denomination of bill could find wide applicability. For example, such an apparatus could be used in a "scaled down" ATM for dispensing small amounts of a single denomination of bill. Such an ATM would have reduced complexity and security requirements. Additionally, such an apparatus, if provided in a compact form, could be incorporated into ordinary vending machines for the purpose of providing change in the form of paper currency. Such an apparatus would be desirable for use in vending machines which dispense items costing several dollars or more, so that the vending machines would not be required to dispense excessive coin in change for purchases made therefrom.

SUMMARY OF THE INVENTION

In accordance with the present invention, there is provided a bill dispensing apparatus for dispensing a selected quantity of currency of a single denomination. The bill dispensing apparatus includes a receptacle for holding a supply of the bills to be dispensed, a first guiding member defining a first guide path, and a feeding mechanism for feeding bills one at a time into the first guide path.

Bills are transported through the first guide path by the feeding mechanism and toward a second guiding member defining a second guide path. The second guide path and the first guide path are separated by a gap between the first and second guiding members. Within the second guide path, a reversible transport mechanism receives the bills from the first guide path and transports the bills toward the terminal end of the second guide path. A misfeed detector is positioned adjacent to the second guide path for detecting whether the feeding mechanism has failed to feed a single bill from the receptacle. If a misfeed is detected, the bills are transported by the transport mechanism into a reject receptacle at the terminal end of the second guide path. If a misfeed is not detected, then the transport mechanism is reversed such that the bills are transported in the reverse direction within the second guide path and toward the gap between the first and second guiding members. Each bill that is transported in the reverse direction then enters the gap and is deflected into a payout receptacle for collection by a customer.

The bill dispensing apparatus is provided with a communication interface for communicating with an external dispense initiator. The communication interface is employed by the bill dispensing apparatus for receiving commands to dispense a specified number of bills, and for transmitting status signals to indicate when the dispense operation is completed or whether the bill dispenser is unavailable for dispensing bills.

BRIEF DESCRIPTION OF THE DRAWINGS

The foregoing summary, as well as the following detailed description, will be best understood when read in connection with the attached drawings in which.

DETAILED DESCRIPTION

Figure 1:
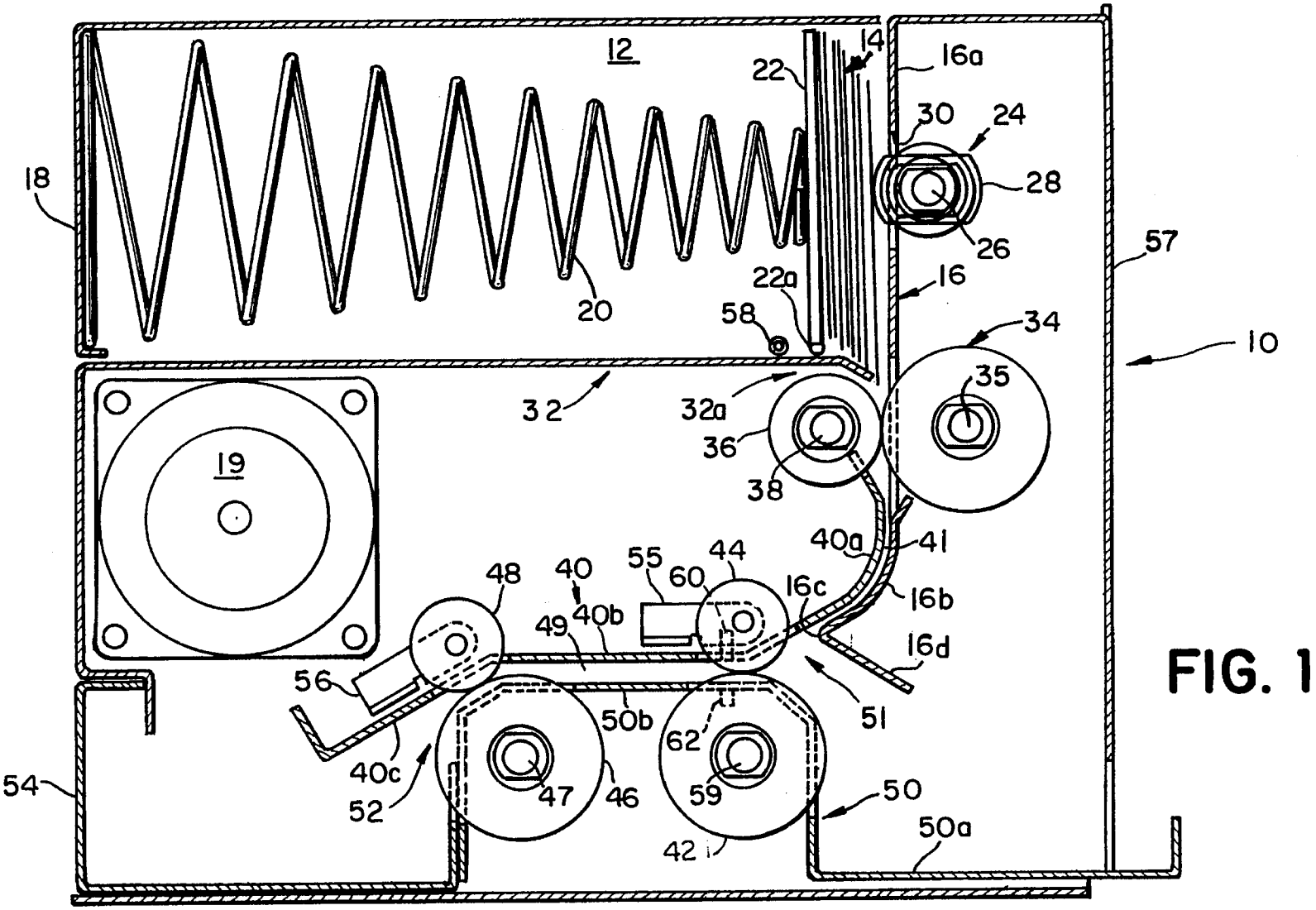
FIG. 1 is a side elevation view in partial section of a single denomination bill dispensing apparatus according to the present invention.

Referring now to FIG. 1, there is shown a bill dispenser 10. The bill dispenser 10 includes a receptacle 12 into which is loaded a stack of bills 14 to be dispensed. The bills 14 are preferably vertically oriented and urged against the flat upper surface **16*a* of a guide plate 16. In the embodiment shown, the stack of bills 14 is pre-loaded into canister 18 which is formed for ready insertion into and removal from the receptacle 12, which is bounded by a bottom wall 32 and the upper portion 16*a* of guide plate 16. A locking mechanism (not shown) may be provided to secure the canister 18 into the receptacle 12 so that the stack of bills is rendered inaccessible to unauthorized persons. Within the canister 18, a conical spring 20 is provided for urging the stack of bills 14 against the upper portion 16***a* of guide plate 16 and adjacent a pair of pickers, of which picker 24 is typical. A pushing plate 22 is attached at one end of the spring 20 for pushing against the stack of bills 14 and for preventing the end of the spring 20 from damaging the bills. In an alternative embodiment, the bills 14 are oriented horizontally within the feeding receptacle and urged against a guide plate and the pickers by the force of gravity.

The pair of pickers, of which picker 24 is typical, are keyed to a picker shaft 26 located on the side of the guide plate 16 opposite from the stack of bills 14. The picker 24 has an oblong frictional surface 28 which extends through a slot 30 in the guide plate 16 and into frictional engagement with the forward end of the stack of bills 14. Motive power for the picker 24, and for other rotatable components of the apparatus 10, is provided by a motor 19 and by a drive train that is described further hereinbelow in connection with FIG. 2. In the preferred embodiment, the motor 19 is a stepping motor; however, a conventional DC motor may be employed. As picker 24 rotates, the frictional engagement between surface 28 and the endmost bill urges the endmost bill into frictional engagement with a pair of feed rollers, of which feed roller 34 is typical, keyed to feed roller shaft 35. The bottom wall 32 of the receptacle 12 is bent downward at the forward end 32*a* thereof in order to shingle the stack of bills 14 as the bills are urged downward by the picker 24 into engagement with the feed roller 34.

A pair of stripper rollers, of which stripper 36 is typical, are keyed to a stripper shaft 38 that is parallel to shaft 35. The stripper roller 36 confronts the feed roller 34, and is rotated counter to the direction of rotation of feed roller 34 so that a stripping action is provided thereby to shingle the bills and to facilitate separation of the bills within the apparatus.

A one-way clutch mechanism (not shown) is provided in the driving linkage between the motor 19 and the respective picker shaft 26, feed roller shaft 35, and stripper shaft 38. When the motor 19 is operated in one direction of rotation, the last-mentioned shafts cooperate to feed a bill in the forward direction of transport. When the direction of rotation of motor 19 is reversed, the clutch disengages, thus ceasing rotation of shafts 26, 35, and 38.

When a bill is fed from the bottom of the stack and passes between the feed roller 34 and the stripper roller 36, the bill then enters an arcuate guide path 41 formed between the lower portion 16*b* of guide plate 16 and the upper portion 40*a* of a second guide plate 40. As the bill is transported through the arcuate guide path 41, the leading edge of the bill is directed by the arcuate guide path toward a nip formed between transport roller 42 and idler roller 44. Transport roller 42 is mounted upon transport shaft 59 beneath a lower guide path 49 formed between a third guide plate 50 and the lower portion 40*b* of second guide plate 40. Idler roller 44 is supported by bracket 55 mounted above the lower guide path 49. The transport roller 42 frictionally engages the bill and urges it toward the lower guide path 49. The transport roller 42 is arranged to provide a greater linear velocity at its periphery relative to the feed roller 34, so that the bill is accelerated into the lower guide path 49 and separated from any partially-overlapping bills. The guide plate 50 and the lower portion 40*b* of guide plate 40 are positioned relative to the arcuate guide path 41 such that the lower guide path 49 defined therebetween obliquely intersects with a tangent of the arcuate guide path 41. When a bill is directed into the lower guide path 49, the bill passes over the top of a knee 16*c* formed in the lower portion 16*b* of guide plate 16. The guide plate 16 is bent at the knee 16*c* in order to form a gap 51 between the knee 16*c* and the lower guide plate 50. The remaining portion of the guide plate 16 below the knee 16*c* forms a stationary deflection vane 16*d* for deflecting bills traveling in the reverse direction, i.e., from within the lower guide path 49 toward the gap 51. As bills are fed in the forward direction from the arcuate guide path 41, the bills bypass the gap 51 and travel along a tangential path extending from the arcuate guide path 41 and into the lower guide path 49.

A light source 60 and photodetector 62 are mounted to the guide plates 40 and 50 respectively, near the transport roller 42. As described in greater detail hereinbelow in connection with FIGS. 5 and 6, the light source 60 and the photodetector 62 are employed in connection with control of the operation of the bill dispenser 10.

A second set of transport rollers, of which transport roller 46 is typical, are mounted upon a transport shaft 47 that is positioned parallel to transport shaft 59. Transport roller 46 cooperates with an idler roller 48 that is supported by a mounting bracket 56 mounted above guide plate 40. The spacing between transport rollers 42 and 46 along the lower guide path is selected to provide continuous frictional engagement of bills that are transported within the lower guide path as the bills are measured by the controller. Ordinarily, a bill will be in frictional engagement with the transport roller 46 by the time that the trailing edge of the bill passes between the light source 60 and the photodetector 62. Hence, the bill will be engaged between the transport roller 46 and the idler roller 48 by the time that the system controller has determined whether a misfeed has occurred. If no misfeed has occurred, and the trailing edge of the bill has passed between the light source 60 and the photodetector 62, then the direction of operation of the motor is reversed by the controller.

Reverse operation of the motor 19 causes transport rollers 46 and 42 to reverse their rotation, and hence to reverse the direction of transport of a bill in the lower guide path 49. When the motor 19 is reversed, picker shaft 26, feed roller shaft 35, and stripper shaft 38 cease to rotate by virtue of the one-way clutch mechanism. When the direction of transport of the bill is reversed, the bill is again engaged by transport roller 42 and the bill again passes between the light source 60 and the photodetector 62. Continued reverse transport of the bill within the lower guide path 49, causes the bill to emerge from the nip between the transport roller 42 and the idler roller 44 and into the gap 51 between the lower guide path 49 and the arcuate guide path 41. The bill is then deflected downwardly by the deflection vane 16*d*. When the bill clears the nip between transport roller 42 and idler roller 44, the bill will then be released into a payout tray 50*a*. The payout tray 50*a* extends beyond the front wall 57 of the bill dispenser 10 so that bills deposited therein can be retrieved by a customer.

When a misfeed does occur, then the rotation of motor 19 is maintained in the forward direction to continue the transport of bills toward the terminal end 52 of the lower guide path 49. The leading edge of a bill is brought into engagement with a deflection vane 40*c* formed in guide plate 40. The bill is deflected downward by deflection vane 40*c*, and is transported out of engagement between transport roller 47 and idler roller 48. As the bills are disengaged from the transport roller 46, they are deposited into a rejected bill receptacle 54 located at the terminal end of the lower guide path 49. The receptacle 54 preferably includes a tray that is secured within the apparatus 10 and can be accessed only by authorized persons for removal of the rejected bills.

Figure 2:
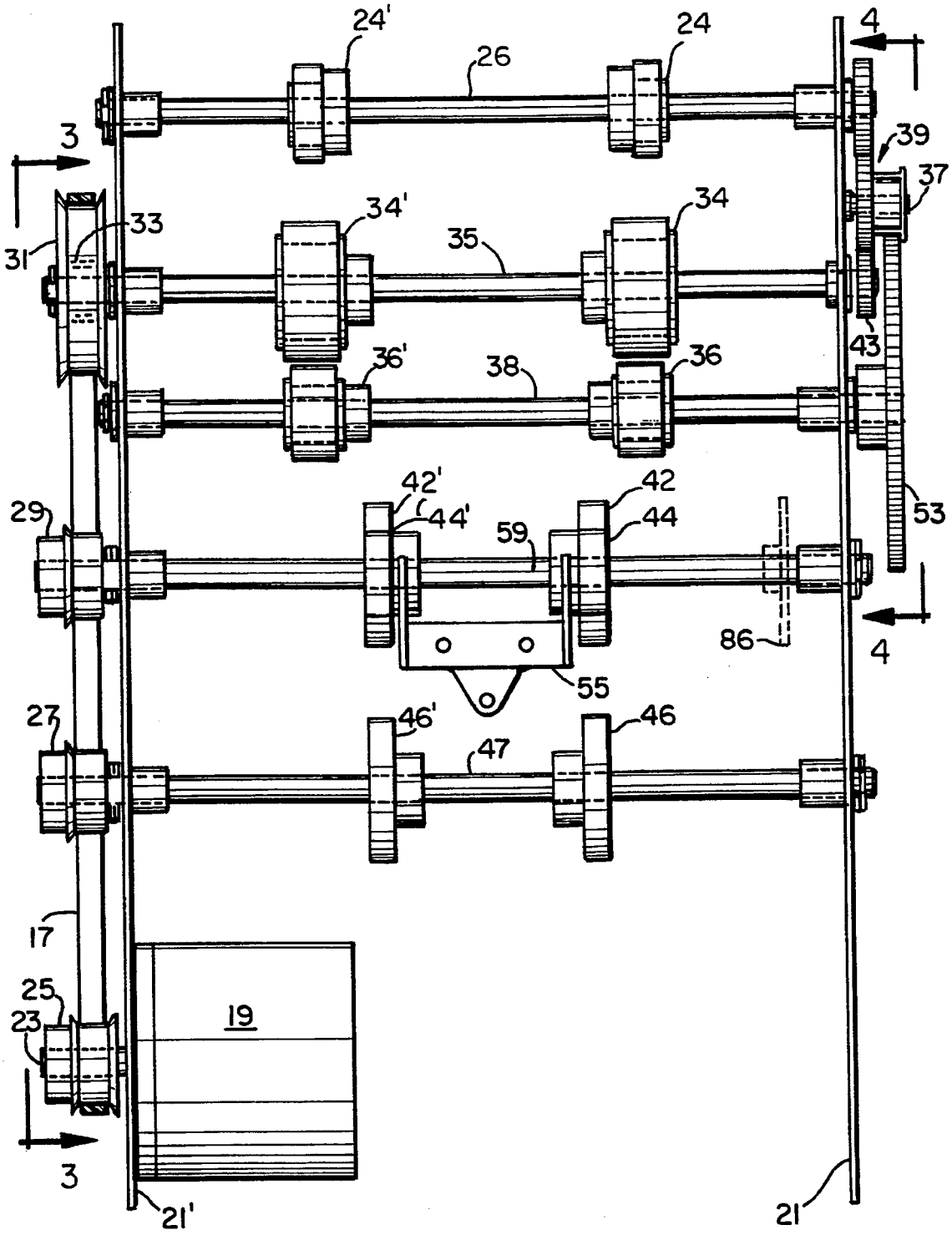
FIG. 2 is a plan view of the shaft drive train of the bill dispensing apparatus of FIG. 1.
Figures 3, 4:
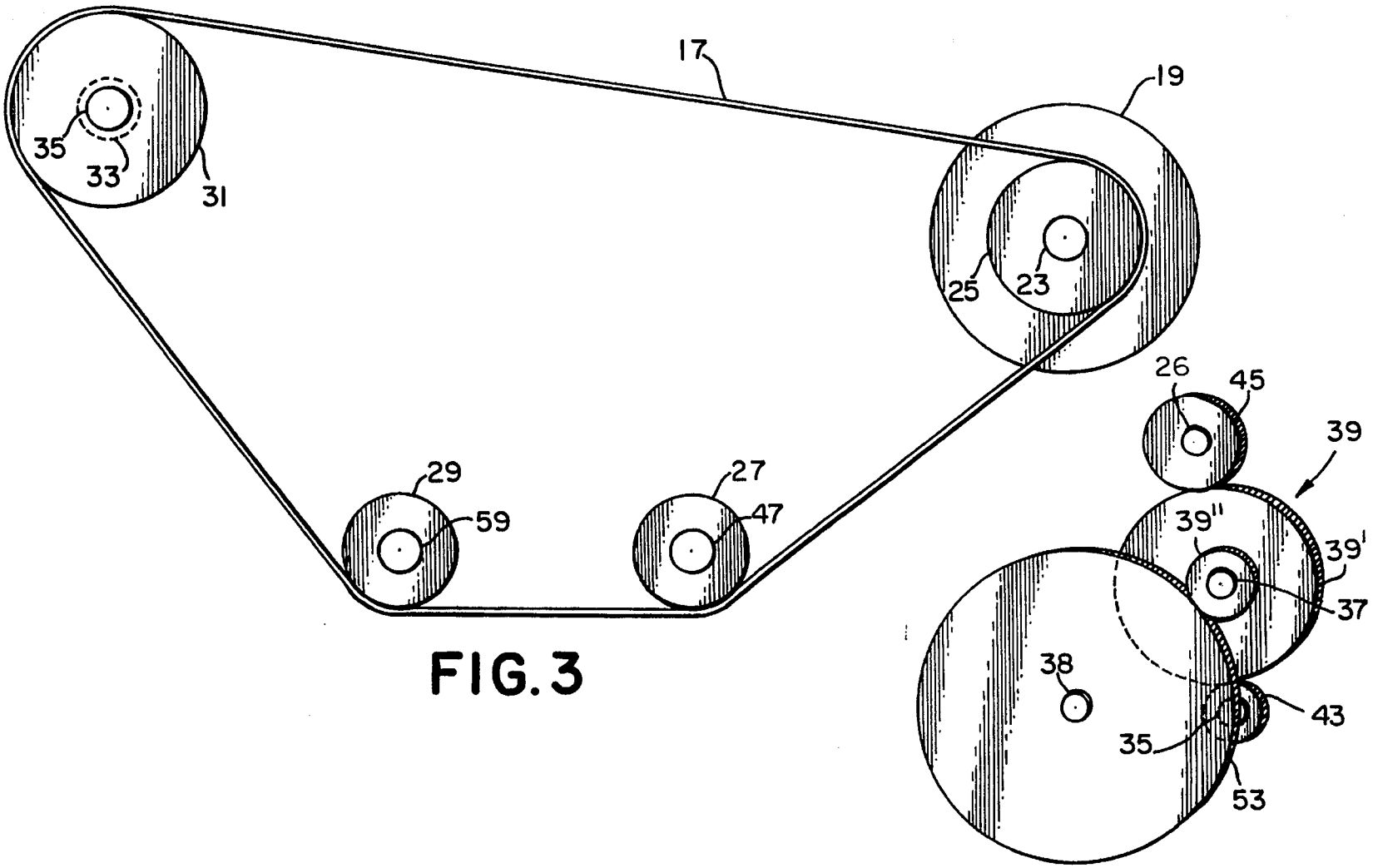
FIG. 3 is an elevation view showing an arrangement of driving components of the bill dispensing apparatus of FIG. 1 taken along the line 3—3 of FIG. 2.
FIG. 4 is an elevation view showing an arrangement of driving components of the bill dispensing apparatus of FIG. 1 as viewed along the line 4—4 of FIG. 2.

A preferred arrangement for the drive train of the bill dispenser 10 according to this invention can be better understood by referring now to FIG. 2. The motor 19 is mounted to an interior wall 21' of the bill dispenser 10. A motor shaft 23 extends through the wall 21' and has a pulley 25 mounted thereon. A belt 17 engages with pulley 25 and also with pulleys 27, 29, and 31 which are mounted upon first ends of shafts 47, 59, and 35, respectively, in order to transmit motive power thereto. The arrangement of belt 17 and pulleys 25, 27, 29, and 31 can best be seen in the side view thereof in FIG. 3. The mounting connection between pulley 31 and the feed roller shaft 35 includes a slip clutch 33, that engages shaft 35 when the motor 19 is operated in the forward direction but not in the reverse direction. The clutch 33 disengages shaft 35 when the motor 19 is operated in the reverse direction thereby limiting shaft 35 to a single direction of rotation.

Referring again to FIG. 2, the feed roller shaft 35 has a gear 43 mounted on a second end thereof for driving the picker shaft 26 and the stripper shaft 38. A combination gear 39 is mounted on an idler stub 37. Combination gear 39 has a first gear portion 39' that engages with gear 43 for transmitting motive power directly to gear 45 mounted on one end of shaft 26. A second gear portion 39" engages with gear 53 mounted on one end of shaft 38. Second gear portion 39" rotates with first gear portion 39' to provide motive power to gear 53. The operative arrangement of gears 43, 39, 45 and 53 can best be seen by reference to FIG. 4. It will be readily appreciated that the driving engagement between shaft 35 and gears 39, 45, and 53 is such that when the motor 19 is operated in the reverse direction, clutch 33 will release the feed roller shaft 35, and thus the shafts 26 and 38 will also cease to rotate.

Figure 5:
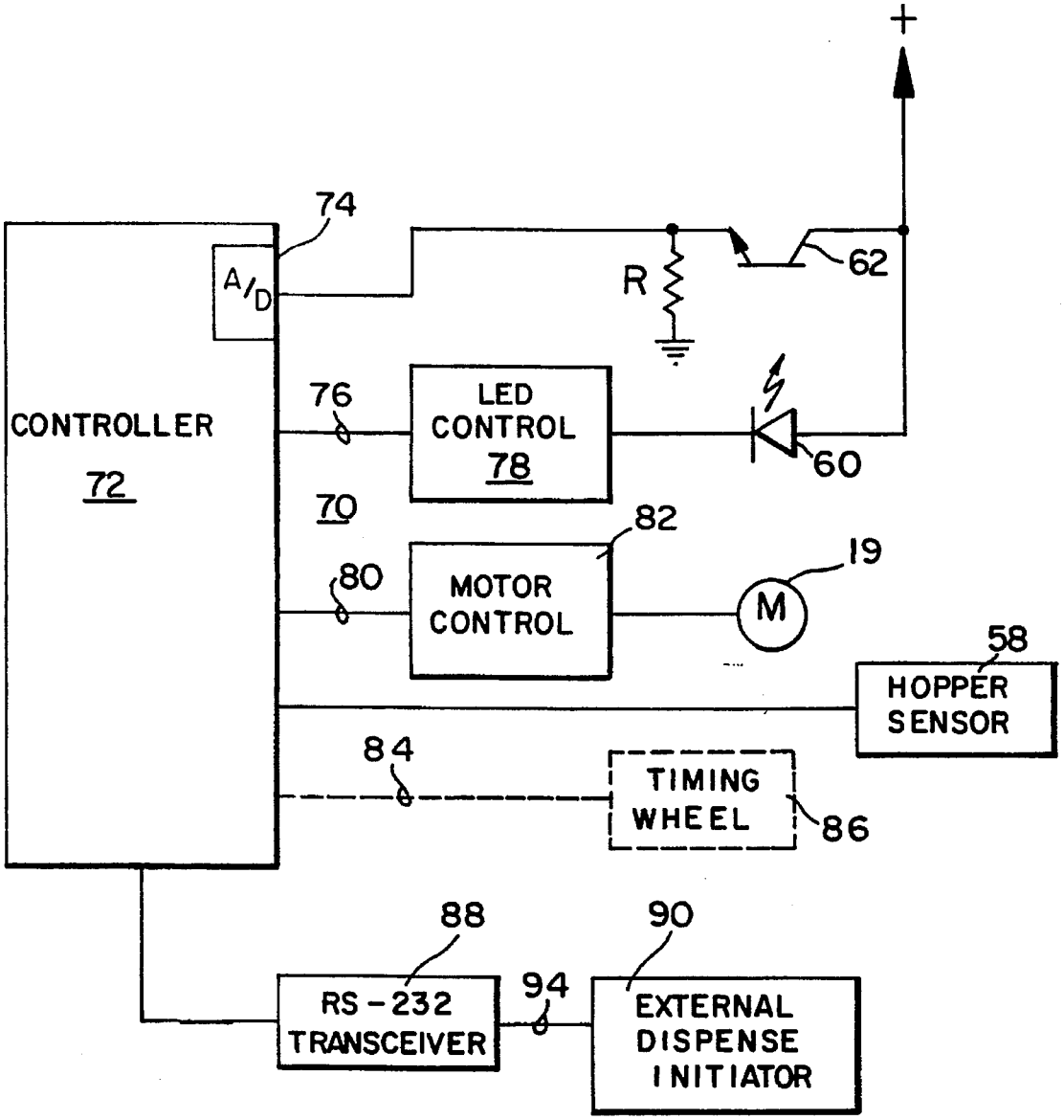
FIG. 5 is a schematic diagram of electronic control circuitry for the apparatus of FIG. 1.

Operation of the dispensing apparatus is monitored and governed by a control network 70 as shown in FIG. 5. The control network 70 includes a controller 72, which is preferably a μPD78C10 microprocessor manufactured by Nippon Electric Company. The preferred controller 72 includes an internal random-access memory (not shown) for storing operational variables; an internal non-volatile memory (not shown) for storing a control program and predetermined operational parameters; and an analog-to-digital (A/D) port 74 for receiving an analog voltage and converting the analog voltage to a digital value. Of course, the functional components of controller 72 can be provided by other well-known, individual components.

Generally, operation of the bill dispenser proceeds as follows. When the leading edge of a bill is detected by the photodetector 62, the controller 72 initiates a count of stepping motor drive pulses. The number of motor drive pulses required to effect transport of the full length of a bill between the light source 60 and the photodetector 62 is indicative of the length of the bill. If a single bill has been properly fed into the lower guide path 49, then the trailing edge of the bill will pass between the light source 60 and the photodetector 62 in due course. When the pulse count exceeds a reference value that is characteristic of the length of a bill, then the controller determines that a misfeed has occurred, and that a "chain", consisting of two or more bills has entered the lower guide path 49.

The light source 60 and the photodetector 62 are also employed by the controller 72 for monitoring the opacity of a bill during transport of the bill into the lower guide path 49. If the opacity of the bill is determined to be above a predetermined threshold level, then the controller 72 interprets such a condition as indicating a "double" misfeed error, that is, two bills have been fed into the lower guide path 49 at approximately the same time. The occurrence of a "chain" or a "double" causes the misfed bills to be deposited in receptacle 54, as described hereinabove.

Photodetector 62 is connected to the A/D port 74 of the controller 72. Light source 60, which is preferably a light-emitting diode (LED), is connected to an LED brightness control circuit 78. The LED brightness control circuit 78 is connected to the controller 72 via signal line 76. The LED brightness control circuit 78 is responsive to control signals generated by the controller 72 and provided upon signal line 76 for operating the light source 60 in at least two different levels of brightness.

In order to provide general applicability of the bill dispensing apparatus, the control network 70 includes a standard data interface, such as an RS-232 (or EIA-232) serial data transceiver 88, so that the control network 70 can be connected to receive an instruction to dispense bills from the external dispense initiator 90 via data connection 94. The external dispense initiator 90 is a device that controls various functions of the machine (e.g., a vending machine) in which the bill dispenser 10 is employed. For example, the external dispense initiator 90 may be embodied as control logic circuitry associated with a vending machine, an ATM, or another type of machine in which bill dispensing is a desired function.

The controller 72 is provided with a control connection 80 to a motor control circuit 82. The motor control circuit receives control signals from the controller 72 and provides the appropriate voltage or voltages for operating the motor 19. In the preferred embodiment, the motor 19 is a stepping motor, and the control signals for operating the motor include step pulses that are initiated by the controller 72 for providing forward or reverse operation. In an alternative embodiment, the motor 19 is a conventional DC motor, and the control signals for operating the motor may include digital values that are interpreted by the motor control circuit 82 for operating the motor in the forward or reverse directions and for stopping the motor.

Figure 6:
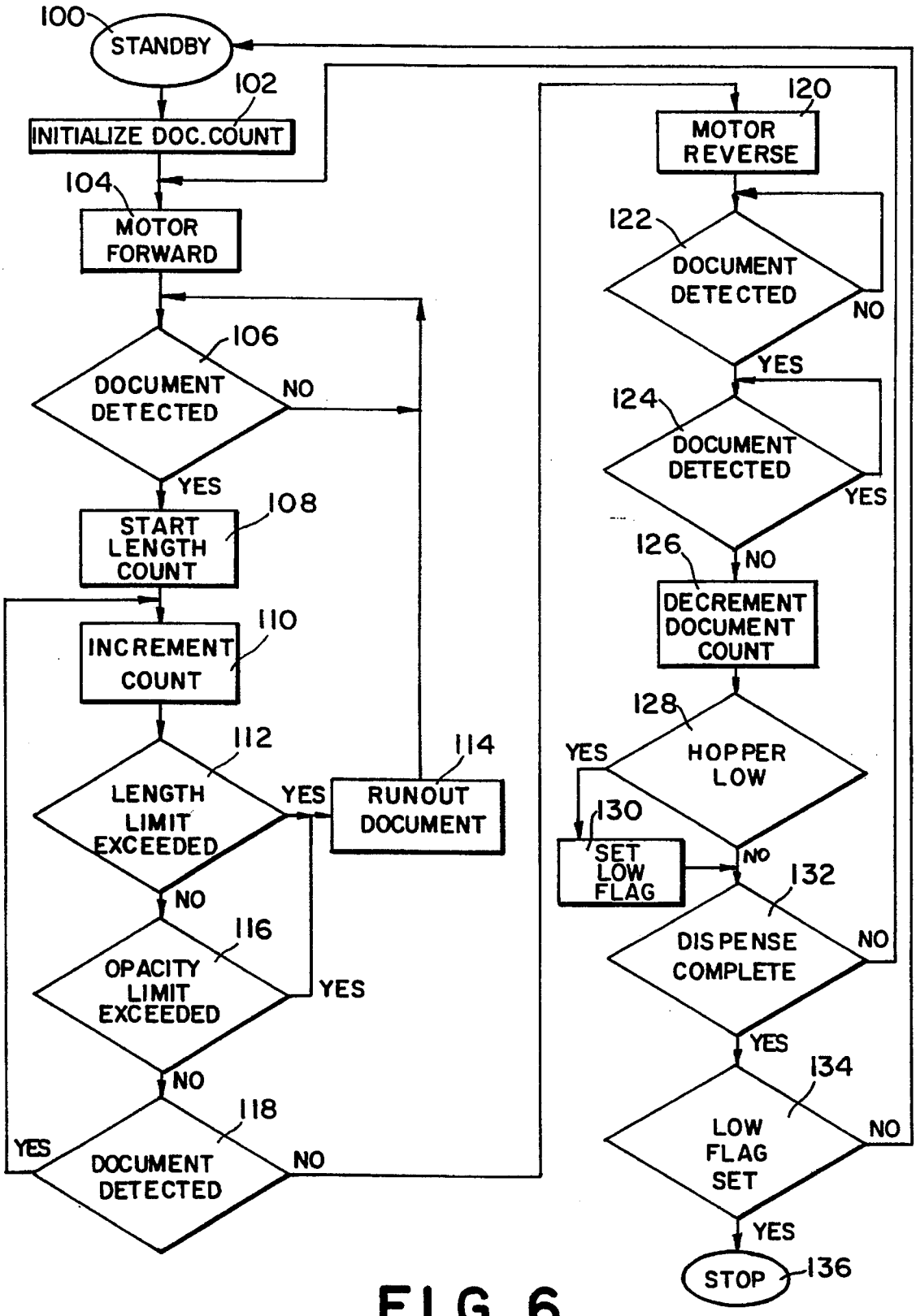
FIG. 6 is a logical flow diagram of a control procedure executed by the control circuitry of FIG. 3 for effecting operation of the apparatus of FIG. 1.

Referring now to FIGS. 5 and 6, the control program executed by controller 72 begins at step 100 in which the controller waits to receive an instruction to dispense one or more bills. Such an instruction is generated by the external dispense initiator 90 and may specify the number of bills to be dispensed.

Upon receiving an instruction to dispense bills, the controller 72 proceeds from step 100 to step 102 in which the controller 72 initializes a bill counting register with the number of bills that have been requested for dispensing. The bill counting register is used by the controller 72 to determine when the requested number of bills have been dispensed. Then, the controller proceeds from step 102 to step 104.

In step 104, the controller 72 initiates forward operation of the motor 19 by providing an appropriate signal or signals to the motor control circuit 82. The motor 19 is started in the forward direction and the controller proceeds from step 104 to step 106.

In step 106, the controller determines whether the leading edge of a bill has entered the lower guide path 49. Prior to and during the step of detecting the presence of a bill in the lower guide path the light source 60 is maintained in a relatively dim condition. During step 106, the controller 72 compares a numerical value provided by A/D port 74 with a reference value indicative of the presence of a bill between the light source 60 and the photodetector 62 when the light source is in a relatively dim condition. If the comparison of step 106 indicates that no bill is present in the lower guide path 49, then the motor 19 is maintained in forward operation and the controller 72 continues to loop within step 106 until a bill is detected. To halt operation of the bill dispenser 10 in response to a malfunction, such as a jam in the upper guide path, an upper limit is placed on the number of times that step 106 is executed. If the upper limit is exceeded, the controller turns off the motor and sends an error signal to the external dispense initiator 90. When, in step 106, a bill is detected between the light source 60 and the photodetector 62, then the controller proceeds from step 106 to step 108.

In step 108, the controller initializes a length counting register which is used to determine the length of the bill as it is received into the lower guide path 49. In the preferred embodiment, the length counting register is utilized to maintain a count of stepping pulses that are provided to the stepping motor 19 to effect forward motion of the bill. In an alternative embodiment, wherein a conventional DC motor is employed, the counting register maintains a count of pulses received from a timing wheel assembly 86 that is keyed to the shaft 59 of transport roller 42. Also in step 108, the controller 72 increases the brightness level of the light source 60 in connection with assessing the opacity of the bill traversing the lower guide path 49. Then, the controller proceeds from step 108 to step 110.

In step 110, the controller 72 provides one or more pulses to the motor control circuit 82 in order to advance the stepping motor 19 in the forward direction by a single step, or by a predetermined number of steps. In an embodiment employing a conventional DC motor, the controller 72 waits to receive a timing pulse from the timing wheel assembly 86, shown in phantom in FIG. 5. The controller 72 then increments the value within the length counting register by the number of drive pulses or timing pulses and proceeds to step 112.

In step 112, the controller 72 compares the value contained within the length counting register with a predetermined reference value corresponding to the proper length of the type of bill being dispensed. As can be appreciated, the value within the length counting register is directly related to the distance that has been traversed by the leading edge of the bill within the lower guide path, as indicated by the number of step pulses that have been applied to the motor or, alternatively, the number of timing pulses that have been received from the timing wheel 86. To allow for skewing and/or slippage of a bill, the predetermined reference value may be slightly greater than the minimum number of pulses required for the entire length of the bill to be received into the lower guide path 49. If, in step 112, it is determined that the length limit has been exceeded, and thus that a misfeed error has occurred, the controller 72 proceeds to step 114. If, in step 112, it is determined that the length limit has not been exceeded, then the controller proceeds to step 116.

In step 114, the motor is continued in forward operation until a bill is no longer detected between the light source 60 and the photodetector 62. Such continued forward operation serves to transport any misfed bills into the rejected bill receptacle 54 or at least to transport any such bills to a position within the lower guide path 49 such that further forward operation of the motor will cause the rejected bills to be transported to the rejected bill receptacle. Then, the controller returns to step 106.

In step 116, the controller determines whether the opacity of the bill exceeds a reference level. This determination is accomplished by comparing the numerical value provided by A/D port 74 with a predetermined reference value corresponding to the maximum acceptable opacity of a single bill. The opacity comparison may be conducted on the basis of a single, instantaneous measurement or by an accumulated total or average of several measurements taken during successive executions of step 116. If, in step 116, it is determined that the opacity of the bill is too high, indicating a "double" misfeed error, then the controller proceeds to step 114. If, in step 116, the numerical value provided by A/D port 74 indicates that the bill has less than the maximum acceptable opacity, then the controller proceeds to step 118.

In step 118 the controller determines whether a bill is present between the light source 60 and the photodetector 62. Such a determination is made on the basis of a comparison of the numerical value provided by A/D port 74 and a predetermined reference value. If, in step 118, it is determined that a bill is still present, then the controller proceeds to step 110 to generate another step pulse for advancing the bill or, alternatively, to await another timing pulse from the timing wheel assembly 86. If, in step 118, it is determined that a bill is no longer present, then the light source 60 is returned to a dim condition and the controller proceeds to step 120.

Step 120 is executed in embodiments employing a conventional DC motor to reverse the direction of the motor. In step 120, the controller issues a control signal to the motor control circuit for reversing the direction of the motor. In the preferred embodiment, wherein a stepping motor is employed, step 120 is omitted and the controller proceeds to step 122.

In step 122, the controller determines whether a bill is present between the light source 60 and the photodetector 62. If no bill is detected, then the controller issues an appropriate step pulse to the motor control circuit to actuate the motor by one or more steps in the reverse direction. The controller continues to operate the motor in the reverse direction and to loop through step 122 until a bill is detected. As can be appreciated, upon initial entry to step 122, a bill should be positioned in the lower guide path at a location slightly beyond the light source 60 and the photodetector 62. Hence, only a few iterations of step 122 should be required in order to transport the bill in the reverse direction before the leading edge of the bill is detected. An additional counting or timing register is employed during step 122 in order to detect whether an unusually high number of iterations have been executed without detection of a bill. In such an instance, it may be inferred that a malfunction has occurred, and the controller 72 then halts execution. Under ordinary circumstances, the leading edge of a bill is detected, and then the controller 72 proceeds from step 122 to step 124.

In step 124, the controller maintains the motor in reverse operation or continues to step the motor in the reverse direction. While the motor is operated in the reverse direction, the controller determines whether a bill is present between the light source 60 and the photodetector 62. As long as a bill is detected, the controller 72 continues to loop through step 124 until a bill is no longer detected. As can be appreciated, during step 124 a bill in the lower guide path is transported, by transfer roller 42, through gap 51 and into engagement with deflection vane **16*d*. When a bill is no longer detected during step 124, it is inferred that the previously-detected bill has been deflected and dropped into the payout tray 50*a* for retrieval by the customer. Then, the controller proceeds to step 126**.

In step 126, the counting register containing the number of bills to be dispensed is decremented by a numeric value of one, since one bill has been dispensed during previous step 124. Then, the controller proceeds to step 128.

In step 128, the controller determines whether the supply of bills within receptacle 12 is nearly depleted. Referring back to FIGS. 1 and 5, a receptacle sensor 58 is positioned within the receptacle 12, and connected with the controller 72, to provide the controller with the ability to determine whether the supply of bills within receptacle 12 has become depleted. The receptacle sensor 58 preferably comprises a cooperating LED and photodetector for detecting the passage of a tab portion 22*a* of the pusher plate 22 therebetween. In an alternative embodiment, the receptacle sensor 58 comprises a magnetic sensor or other sensing device for detecting the near depletion of bills within the receptacle 12. If, in step 128, it is determined that the supply of bills is depleted to the extent that there may not be a sufficient supply for a subsequent dispensing operation, then the controller proceeds to step 130. For example, in a vending machine capable of accepting a ten dollar bill, and capable of dispensing merchandise costing two dollars or more, the sensor 58 would be arranged to signal near depletion if there were less than eight dollar bills remaining in the receptacle 12. If, in step 128, the supply is deemed sufficient for a subsequent dispensing operation, then the controller proceeds to step 132.

In step 130, the controller sets a "low supply" control flag for indicating that the supply of bills has been determined to be potentially insufficient for a subsequent dispensing operation. Then, the controller proceeds to step 132.

In step 132, the controller determines whether the dispensing operation has been completed. Completion of the dispensing operation is realized when the bill counting register has been decremented to zero. If, in step 132, it is determined that more bills are to be dispensed, then the controller 72 returns to step 104. If, in step 132, it is determined that the dispensing operation has been completed, then the controller proceeds to step 134.

In step 134, the controller determines whether the "low supply" control flag was set in step 128. If, in step 134, the "low supply" flag is found to be set, then the controller proceeds to step 136. Otherwise, the controller returns to step 100.

In step 136, the controller turns off the bill dispensing apparatus and goes offline. Prior to ceasing operation, the controller may send a message to the external dispense initiator 90, via the RS-232 transceiver 88, that the bill dispenser is in need of re-supply or other service, and that the bill dispenser will no longer be available for dispensing bills. In embodiments wherein a conventional DC motor is employed, the motor is turned off during step 136.

The terms and expressions which have been employed in the foregoing are used as terms of description and not of limitation, and there is no intention in the use of such terms and expressions of excluding any equivalents of the features shown and described, or portions thereof, but it is recognized that various modifications are possible within the scope of the invention claimed.

That which is claimed is:

1. An apparatus for dispensing bills, comprising:

a first receptacle for holding a plurality of bills;

first guiding means defining a first portion of a guide path that is in communication with said first receptacle;

second guiding means defining a second portion of the guide path, said second guiding means being separated from said first guiding means by a gap therebetween along one side of the guide path, said second portion of said guide path having a first end adjacent to the gap and having a terminal end distal from the gap;

a feeding mechanism connected with the first receptacle for feeding bills from the first receptacle into the first portion of the guide path;

transport means for receiving bills from the first portion of the guide path and transporting the received bills into the second portion of the guide path such that the bills bypass the gap;

misfeed detection means for detecting a misfeed condition in the guide path;

a second receptacle disposed for receiving bills from the first end of the second portion of the guide path;

a third receptacle disposed for receiving bills from the terminal end of the second portion of the guide path; and transport control means operatively connected with said transport means and responsive to said misfeed detection means for reversing operation of said transport means such that a bill within the second portion of the guide path is transported toward said second receptacle in the absence of the detection of a misfeed by said misfeed detection means.

2. The apparatus of claim 1, comprising:

an external communication port for receiving an instruction to dispense bills, said instruction including a number of bills to be dispensed; and wherein said transport control means is responsive to said instruction for operating said transport means to dispense said number of bills into said second receptacle.

3. The apparatus of claim 2 comprising depletion sensor means connected with said transport control means for producing a depletion signal as said plurality of bills is depleted, and wherein said transport control means is responsive to said depletion signal for signalling depletion of said plurality of bills via said communication port.

4. The apparatus of claim 1, comprising:

a reversible motor responsive to said transport control means for supplying motive power to said feeding mechanism and to said transport means; and a drive train for transmitting said motive power from said motor to said feeding mechanism and to said transport means, said drive train including a clutch for suspending transmission of said motive power to said feeding mechanism when said transport control means reverses the operation of said reversible motor.

5. The apparatus of claim 4 wherein said misfeed detection means comprises a photosensor for producing a photosensor signal, and wherein said transport control means is responsive to the photosensor signal for detecting the presence and measuring the length of a bill within said second portion of the guide path.

6. The apparatus of claim 5 wherein said transport control means is responsive to the photosensor signal for measuring the opacity of the bill, and for reversing the operation of said reversible motor when the measured length and opacity of the bill are indicative of a genuine bill.

7. The apparatus of claim 6 wherein said transport control means is responsive to the photosensor signal for maintaining the direction of operation of said reversible motor when the length or opacity of the bill are indicative of a misfeed.

8. The apparatus of claim 5 wherein said reversible motor is a stepping motor and wherein:

said transport control means is connected to provide stepping signals to said motor to effect operation of the motor in one of two directions of rotation; and said transport control means maintains a count of stepping signals provided during detection of a bill by said photosensor, whereby the length of the bill is measured.

9. The apparatus of claim 5 comprising a timing wheel operatively connected to said reversible motor for providing timing signals to said transport control means, and wherein said transport control means is responsive to said timing signals during detection of a bill by said photosensor, for measuring the length of the bill.

10. The apparatus of claim 1 wherein said first receptacle comprises a spring positioned for urging the plurality of bills toward said feeding mechanism.

11. The apparatus of claim 1 wherein said first receptacle comprises a removable canister.

12. The apparatus of claim 1 wherein said first guiding means comprises an arcuate member adjacent to said gap for guiding a bill toward said transport means along a tangent to the curve of said arcuate member.

13. The apparatus of claim 12 wherein said first end of the second portion of the guide path is located along said tangent, and wherein said second guiding means comprises a guiding member positioned at an oblique angle to said tangent, whereby the bill is transported into the gap when the transport means is reversed.

14. A machine for vending goods having the apparatus of claim 1 installed therein for dispensing said bills in change for purchases made therefrom.

15. An apparatus for dispensing bills, comprising:

a communication link for receiving control signals from an external dispense initiator, said control signals including a command to dispense a specified number of bills;

a supply receptacle for containing a supply of bills a first receiving receptacle for receiving the specified number of bills a first guide plate defining a first guide path within the apparatus, the first guide path having an upper end and a lower end, and the first guide plate having a knee at the lower end of the guide path forming a deflection vane extending outward from the guide path and toward the first receiving receptacle;

a feeding mechanism for feeding bills from the supply receptacle into the upper end of the guide path a second guide plate defining a second guide path having a first end and a second end, said first end spaced apart from the lower end of the first guide path forming a gap between said first guide path and said second guide path;

a transport mechanism for transporting bills in a first direction from the lower end of the first guide path and into the first end of the second guide path toward the second end of the second guide path, and for transporting bills in a second direction from the second guide path and into the gap such that the bills are deflected by the deflection vane into the first receiving receptacle;

a controller operatively connected with said transport mechanism, having a sensor positioned within said second guide path for determining whether more than one bill is present within the second guide path, said controller responsive to the sensor for operating the transport mechanism in the first direction if more than one bill is present within the second guide path and for operating the transport mechanism in the second direction if a single bill is located within the second guide path;

a second receiving receptacle positioned at the second end of the second guide path for receiving bills transported in the first direction therein.

* * * * *